United States Patent [19]

Berkeland et al.

[11] 4,039,129

[45] Aug. 2, 1977

[54] BRACKET FOR SMOKE AND FUME EJECTOR FAN

[76] Inventors: James E. Berkeland, 3329 Nesta Drive, San Jose, Calif. 95118; Ralph H. Donnelly, 425 Hershner Drive, Los Gatos, Calif. 95030

[21] Appl. No.: 670,274

[22] Filed: Mar. 25, 1976

[51] Int. Cl.[2] ..... F16M 11/04; H01H 3/16

[52] U.S. Cl. ..... 248/14; 24/263 A; 248/211; 248/226.4

[58] Field of Search ..... 248/14, 215, 226 A, 248/226 B, 228, 291, 210, 211, 238; 24/263 PJ, 263 FS, 263 A, 263 DB, 243 S, 243 CC, 243 B; 416/244 R

[56] References Cited

U.S. PATENT DOCUMENTS

| | | | |
|---|---|---|---|
| 1,707,894 | 4/1929 | Bergesen | 248/228 X |
| 2,543,900 | 3/1951 | Dudley | 248/226 B X |
| 2,585,592 | 2/1952 | Sears | 248/291 UX |
| 3,653,624 | 4/1972 | Abel | 248/215 X |

*Primary Examiner*—J. Franklin Foss
*Attorney, Agent, or Firm*—John J. Leavitt

[57] ABSTRACT

Presented is a bracket assembly on which may be mounted a fan assembly for ejecting smoke or fumes from a building or enclosure.

5 Claims, 6 Drawing Figures

BRACKET FOR SMOKE AND FUME EJECTOR FAN

BACKGROUND OF THE INVENTION

This invention relates to brackets, and particularly to a bracket that may be mounted in a window or door opening, supported on the door or the wall structure itself, or supported on auxiliary equipment such as a ladder, for the purpose of ejecting smoke-laden air or fumes from a building or other enclosure.

Fans of various types have been used for causing movement of air in a building. In most instances, such fans are not made to handle the capacity of air that is required to be ejected from a burning building or a building full of toxic fumes. Additionally, in most instances such fans are provided with a self supporting stand on which the fan is mounted, generally on a table or on the floor. So far as is known, high capacity fans have not been equipped with a support that permits mounting of the fan assembly in an open doorway, window, or on auxiliary equipment such as a fire ladder. Accordingly, one of the objects of the present invention is to provide a bracket assembly on which may be mounted a fan structure so that the fan and bracket assembly may be supported in an open doorway or window or on auxiliary equipment such as a ladder.

Some doorways and windows are provided with trim pieces on which a piece of equipment may be suspended. Accordingly, one of the objects of this invention is to provide a bracket assembly that may be detachably secured to an opening provided with a trim assembly to form an abutment on which the bracket may be suspended.

Other door openings and window openings are not provided with any kind of trim piece, or if they are provided with a trim piece, the trim piece is frequently recessed so that the wall surrounding the opening provides a flush surface. In these circumstances, it is more difficult to secure a piece of equipment thereto. Accordingly, a still further object of the invention is to provide a clamp assembly for clamping a supporting bar to the wall structure surrounding such an opening, and on which a fan supporting bracket assembly may in turn be suspended.

Frequently, when a fire department responds to a fire, it is imperative that the smoke generated within the building by the fire be ejected in the shortest possible time. Accordingly, another object of this invention is the provision of a bracket assembly for an ejector fan that may be quickly attached to the wall structure in the vicinity of an opening.

It is also important when mounting a smoke ejector fan such as the one forming the subject matter of this invention that the fan assembly be readily adjustable in its position on the bracket assembly supporting it. Accordingly, another object of the invention is the provision of a bracket assembly for suspending a smoke ejector fan such that the fan assembly may be adjusted in position on the bracket without dislodging the bracket from its supporting structure.

The invention possesses other objects and features of advantage, some of which, with the foregoing, will be apparent from the following, description and the drawings. It is to be understood, however, that the invention is not limited to the embodiment illustrated and described, since it may be embodied in various forms within the scope of the appended claims.

SUMMARY OF THE INVENTION

In terms of broad inclusion, in one of its aspects, the invention comprises a fan support assembly comprising a base plate adapted to hook onto a door frame or the top edge of a door, and having rotatably mounted thereon and frictionally engaged therewith a second fan mounting plate that permits mounting of a fan assembly thereon for adjustment into various positions. In another aspect of the invention, there is included a clamp assembly that may be clamped to a vertical supporting wall and having a suspensory bar thereon from which the base plate is suspended. In this aspect of the invention, a fan mounting plate is pivotally mounted on the fan assembly thereon.

DESCRIPTION OF THE PREFERRED EMBODIMENT

There has been a continuing need for a fan and bracket assembly for use by firemen and industrial safety crews, the assembly preferably being light and portable and easily mountable on existing structure at the location of a fire. For instance, it frequently happens that smoke must be ejected from a burning building before rescue workers can enter the building, or for the purpose of the preservation of life within the building in the interval between the time that rescue workers arrive on the scene and the time that persons rendered unconscious because of smoke inhalation or other causes have been found. In the past, fan assemblies have been supported from makeshift hangers that attach to the wall in a doorway in such fashion that ingress and egress through the doorway is hampered, and which prevented tilting of the fan body so as to suck smoke from areas of concentration such as near a ceiling in a burning building. The fan and support bracket assembly of this invention permits the fan and bracket assembly to be quickly attached to a supporting structure and permits adjustability so as to extract smoke from whatever direction is necessary.

Frequently, it is necessary to extract smoke from an attic area where the only access to the area is a relatively small opening in the ceiling of a hallway. Heretofore, there has been no pratical way to suspend an ejector fan in such an opening. The fan and bracket assembly of this invention permits the support of a smoke ejector fan in close proximity to such an attic opening for the purpose of ejecting smoke therefrom.

Figure 1:
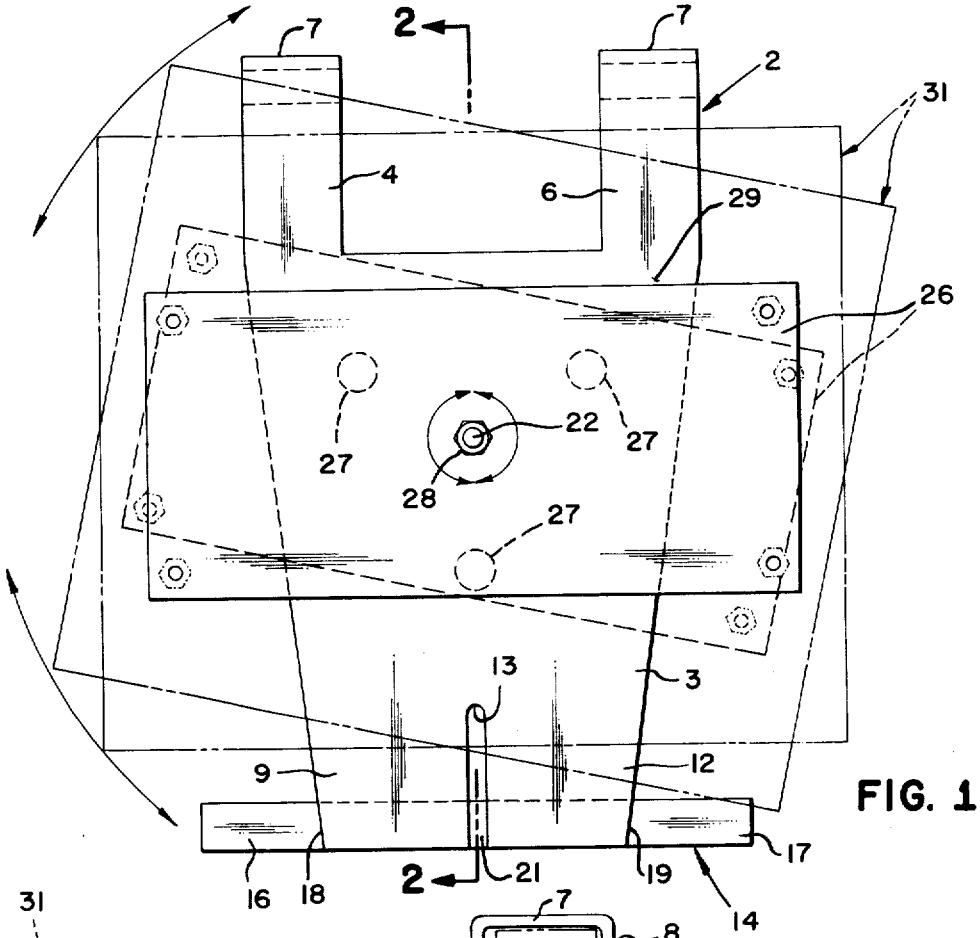
FIG. 1 is a rear elevational view of the bracket assembly viewed from the side on which the fan assembly is mounted.

Referring to FIG. 1, it will there be seen that the bracket comprises a base plate designated generally by the numeral 2 and having a relatively wide body portion 3 having bifurcated extensions 4 and 6 at one end, each of the bifurcated extensions having a perpendicular portion 7 extending therefrom, terminating in a reentrant portion 8 to form a pair of hooks at one end of the main body of the support plate.

At its opposite end, the support plate is provided with bifurcated extensions 9 and 12 defining a slot 13 therebetween for purposes which will hereinafter be explained. Across the end of the bifurcated extensions 9 and 12 is securely welded or otherwise secured a crossbar designated generally by the numeral 14 and having end portions 16 and 17 projecting beyond the lateral edges 18 and 19, respectively, of the main support plate. It will be noted that the crossbar 14 extends across the slot 13 in a portion 21.

Figure 2:
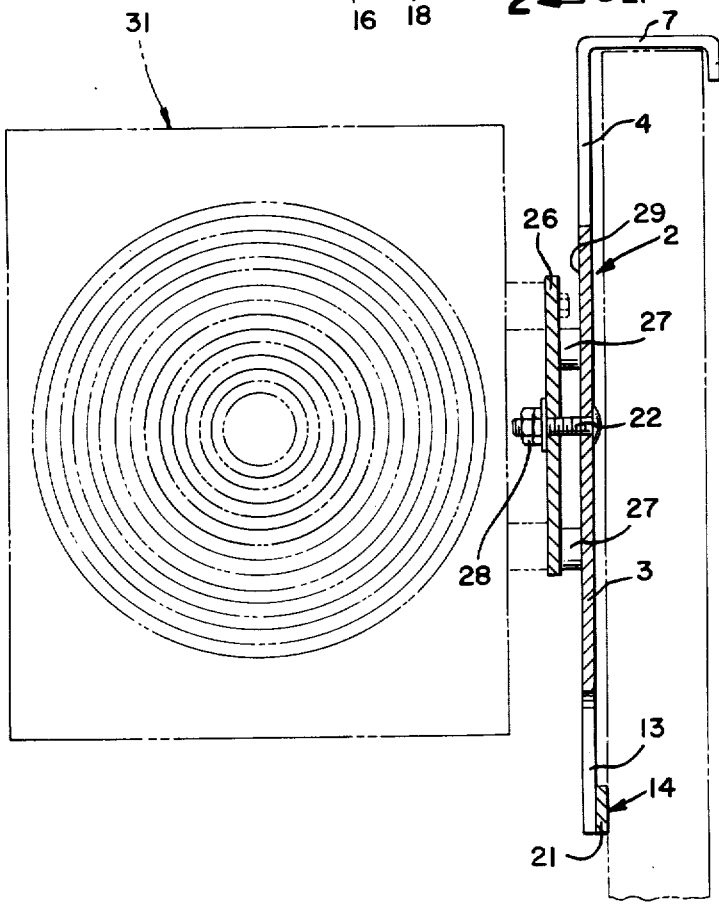
FIG. 2 is a vertical cross sectional view taken in the plane indicated by the line 2-2 in FIG. 1 and showing the bracket hooked over the top of a door and supporting a fan assembly, the latter being shown in broken lines.
Figure 4:
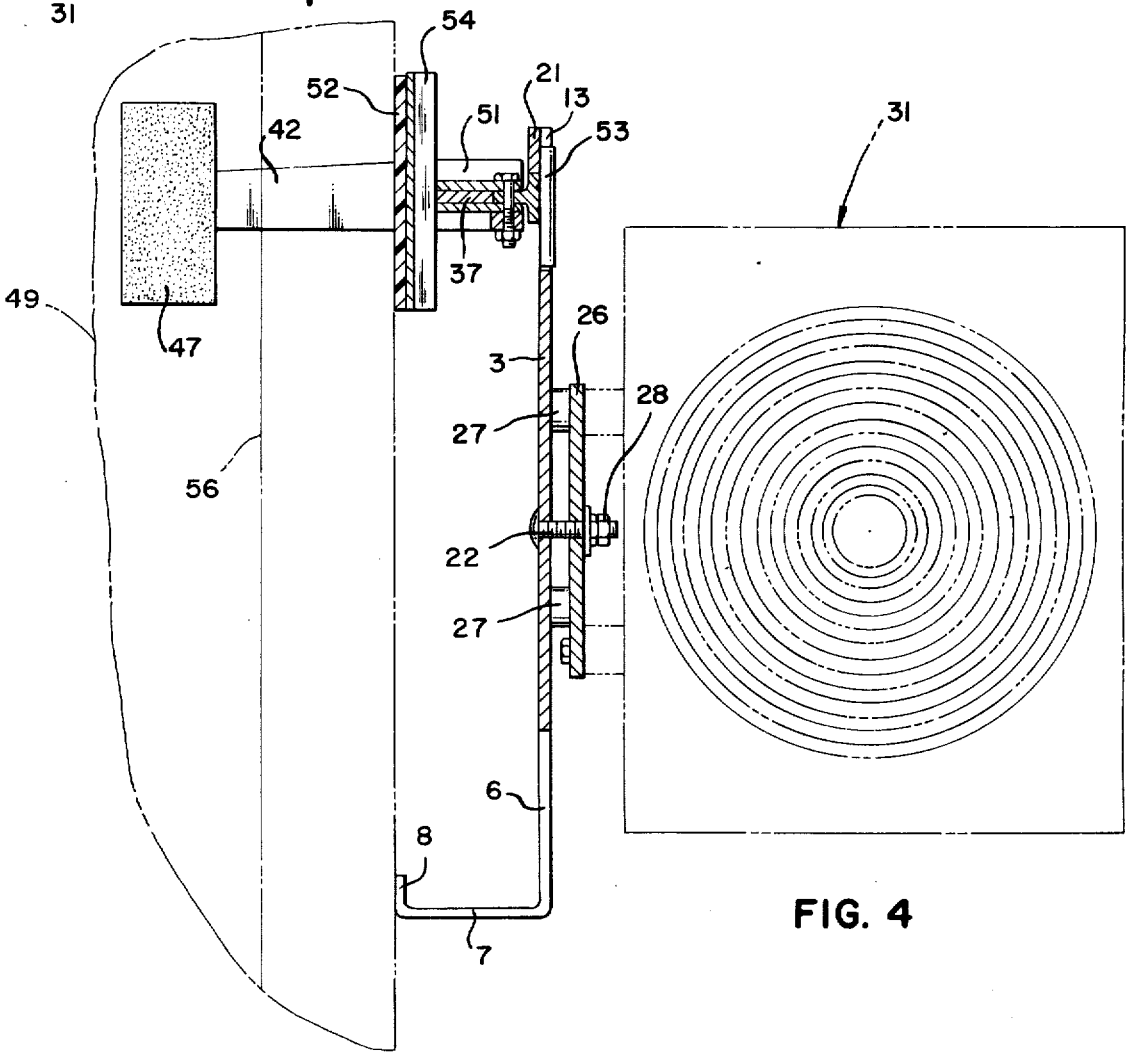
FIG. 4 is a vertical cross sectional view taken in the plane indicated by the line 4—4 in FIG. 3.

Centrally disposed in the main body 3 of the base plate 2 is a mounting bolt 22 welded or otherwise attached to the base plate as shown best in FIGS. 2 and 4, and utilized to claim to the base plate an adjustably rotatable mounting plate 26 having a generally rectangular configuration as illustrated in FIG. 1, and being spaced from the central body portion of the base plate by a plurality of spacers 27 spaced about the mounting bolt 22 which is provided with lock nuts 28. Thus, it will be seen that when the nuts 28 are turned down on the mounting bolt 22, it imposes a compressive stress on the spacers 27, causing a variable degree of friction to be generated between the spacers 27 and the surface 29 of the main body portion of the base plate 2. Thus, by adjusting the degree of friction so generated, the rotatable mounting plate 26 may be adjusted to any desired position about the mounting bolt 22. Alternate positions are indicated by broken lines in FIG. 1 for both the mounting plate 26 and the fan assembly 31 shown in broken lines in FIGS. 1 and 2. Equivalent friction generating means may of course be substituted for the spacers 27.

Figure 5:
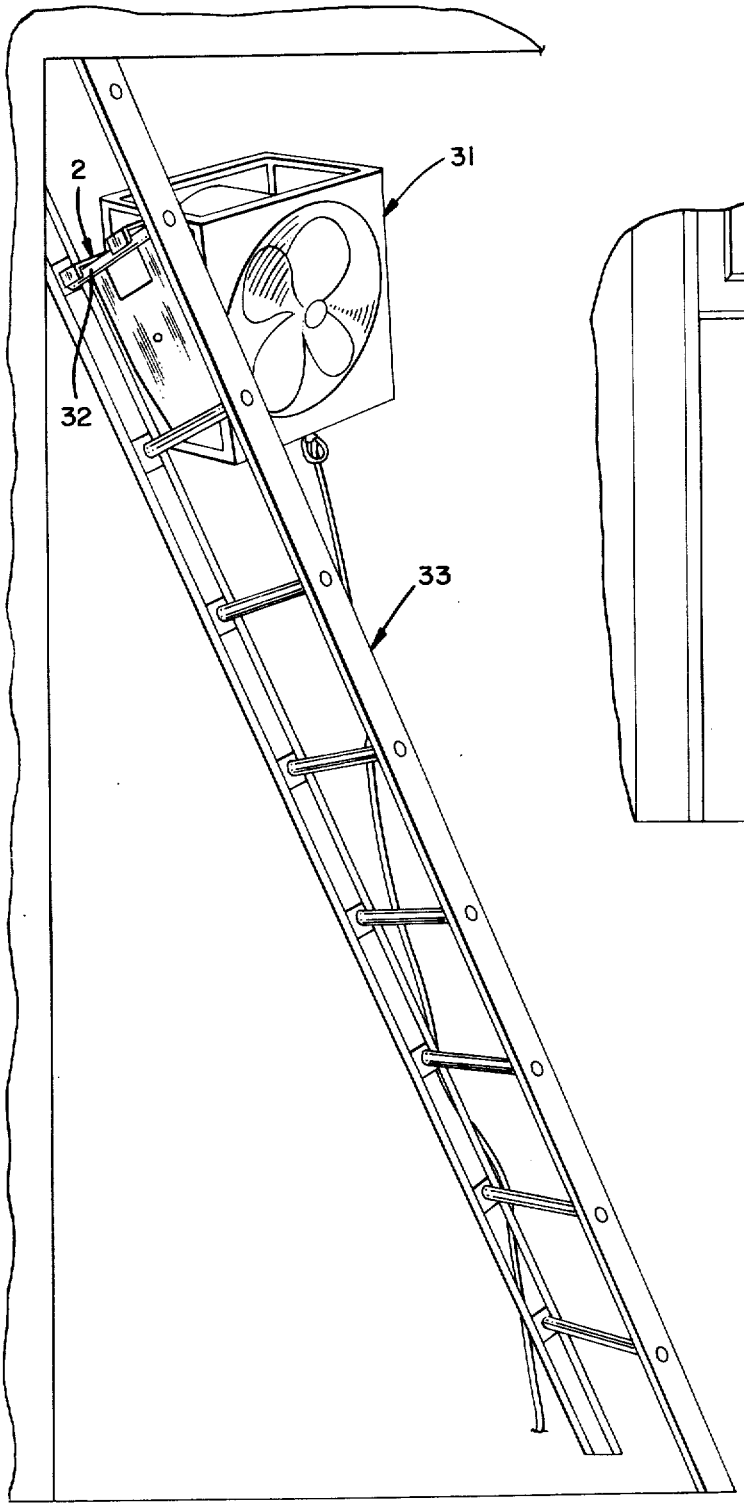
FIG. 5 is a perspective view illustrating the fan and bracket assembly mounted on a ladder.
Figure 6:
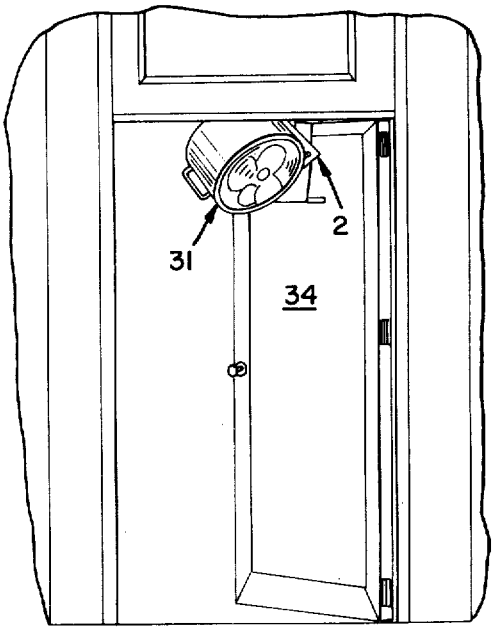
FIG. 6 is a perspective view illustrating the fan and bracket assembly suspended from the top of an open door.

The spacers 27 are fixed to the rotatable mounting plate 26 and slide over the surface 29 of the base plate when the fan assembly and its mounting plate 26 are adjusting from one position to another through 360°. Preferably, the amount of friction imposed between the rotatable mounting plate 26 and the base plate 29 is such that the relatively heavy fan assembly may be adjusted to any position and will retain such position despite the fact that a certain amount of vibration may be expected from such an assembly. Thus, as illustrated in FIG. 5, the fan assembly, with the mounting bracket attached thereto may be suspended from the rug 32 of a ladder designated generally by the numeral 33 the ladder being mounted adjacent a large opening such as a garage door opening, for instance. On the other hand, where necessary, the fan and bracket assembly may be suspended from the top edge of a door designated generally by the numeral 34 as illustrated in FIG. 6, with the fan assembly being titled so as to draw smoke laden air from near the ceiling of the room in which it is mounted, so as to discharge such smoke laden air out the opening toward which it is pointed.

Figure 3:
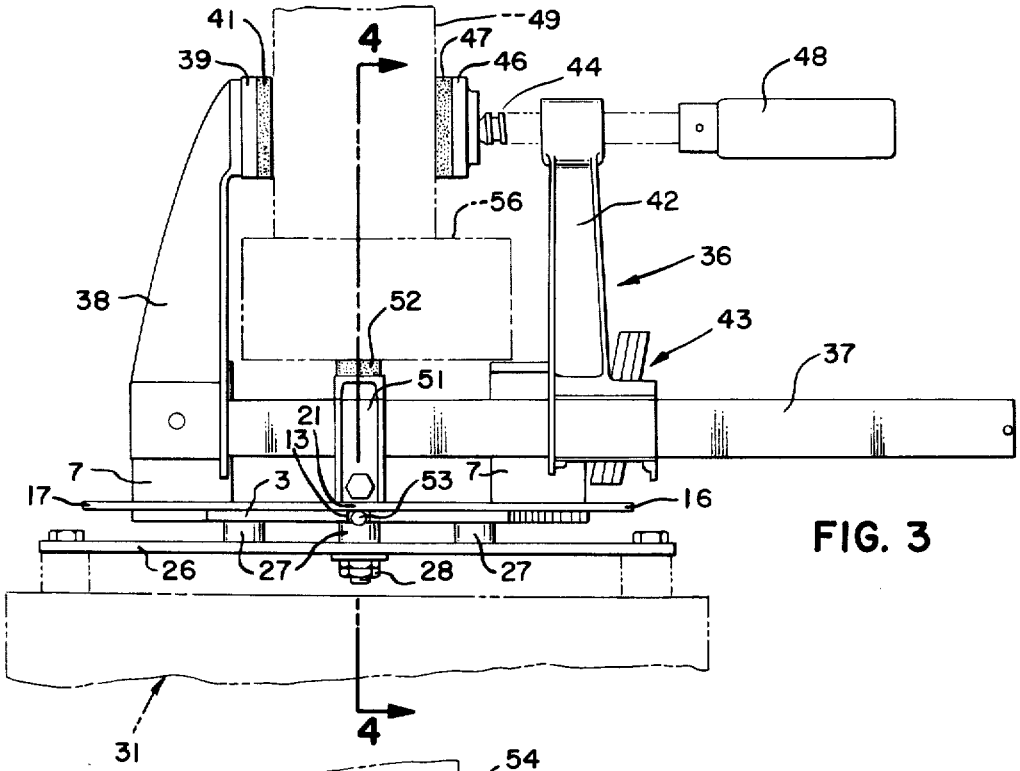
FIG. 3 is a plan view illustrating a clamp assembly for attachment to the smooth surfaces of a wall and providing means for suspending the bracket assembly on which the fan is mounted.

In the embodiment of the invention illustrated in FIG. 3, a clamp assembly designated generally by the numeral 36 is used to support the fan and bracket assemblies in a doorway that is not otherwise equipped with supporting structure such as a trim piece over which the hooks 8 may be engaged, or in an opening that does not have a door over the top edge of which the hooks 7 may be engaged. The clamp assembly 36 may generally be of the type provided with a slide bar 37, on one end of which is mounted a clamp arm 38 having a jaw 39 on which is mounted a resilient pad 41. Also mounted on the slide bar is a slidable clamp arm 42 having lock plates designated generally by the numeral 43, normally spring pressed in a direction to releaseably lock the slide clamp arm 42 to the slide bar 37 at or near the adjusted position of the clamp. The slide clamp arm 42 carries on its free end a spindle 44 on the end of which is mounted a clamp plate 46 on which is in turn mounted a resilient pad 47. Rotation of the handle 48 effects clamping of the clamp assembly 36 to the interposed wall 49 which may, for instance, be a glass door.

Slidably disposed on the slide bar 37 in the space between the clamp arms 38 and 42, is a bearing member 51 having a resilient pad 52 thereon formed of some appropriate material. The bearing member 51 is slidably disposed on the slide bar 37 between the limits imposed on the left by the clamp arm 38 and on the right by the clamp arm 42. Mounted on the end of the slide bearing 51 opposite the resilient pad 52 is a vertically disposed pin 53 which is welded or otherwise mounted on the slide bearing so that it projects the same direction as the pad 52, which, as seen in FIG. 4, in mounted on an elongated channel member 54 welded to the bearing member 51.

It will thus be seen that when the clamp assembly 36 is utilized to provide a mounting for the fan and bracket assembly the clamp arms 38 and 42 are adjusted so as to impinge against opposite sides of the wall by unlocking the latch 43 and sliding the slide clamp arm 42 toward the adjacent surface of the wall until the pad 47 impinges thereagainst. Thereupon, the handle 48 is turned so as to impose greater force on the wall through advancement of the spindle 44. It will of course be obvious from FIG. 3 that for maximum security in the placement of the clamp assembly 36, the slide bearing 51 carrying resilient pad 52 is adjusted so that it impinges against the end of the wall structure 49, or, when necessary, a spacer block 56 may be interposed between the end of the wall and the pad 52 as shown. Thus, with the clamp securely mounted on the edge of the wall, the lock pin or rod 53 is in position to be engaged in the slot 13 formed in the base plate 2, the portion 21 of the crossbar 14 locking behind the upper end of the pin 53 as illustrated in FIG. 4, while the remainder of the pin 53 lies in slot 13, thus preventing inadvertent dislodgement of the support bracket from the clamp assembly. In the position illustrated in FIG. 4, it will be noted that the hook portions 7-8 of the support plate 3 impinge against the same surface against which the resilient pad 52 impinges. Thus, the bracket assembly is securely suspended from the clamp assembly, and the mounting plate 26 is permitted to be adjusted to any desired position as previously discussed.

We claim:

1. A bracket assembly for a smoke ejector fan, comprising:

a. a base plate;

b. a fan mounting plate rotatably mounted on the base plate;

c. means interposed between the base plate and fan-mounting plate tending to retain the mounting plate in an adjusted position against a force tending to effect rotation thereof;

d. said base plate being provided with a pair of bifurcated extensions at each of two opposite ends defining a slot therebetween, one of said pairs of bifurcated extensions terminating in spaced hooks for suspending the bracket assembly from a door or ladder; and e. a bar fixed to said base plate and extending across the other pair of said bifurcated extensions and the associated slot and providing lateral portions extending on opposite sides of said bifurcated extensions.

2. The combination according to claim 1, in which said means interposed between the base plate and fan-mounting plate comprise friction pads secured to said fan-mounting plate at points spaced from the axis of rotation thereof and rotatable therewith while frictionally engaging the base plate.

3. The combination according to claim 1, in which clamp means are provided for attachment to a supporting structure, said claim means including a lock rod thereon detachably engageable with the bar on said base plate and the associated slot to suspend said base plate from said clamp means.

4. A clamp assembly comprising:

a. a slide bar;

b. a first clamp arm fixed on one end of the slide bar and extending substantially perpendicularly therefrom to provide a clamping surface spaced from said slide bar;

c. a second clamp arm slidably mounted on the slide bar for selective movement toward and away from said fist clamp arm, said second clamp arm extending substantially perpendicular to said first clamp arm and including means spaced from said slide bar adjustable to impose a clamping force on an object disposed between said first and second clamp arms;

d. means normally resiliently locking said second clamp arm to said slide bar and selectively releasable to permit sliding adjustment of the second clamp arm along the slide bar; and e. a slidably adjustable bearing block slidably mounted on the slide bar between said first and second clamp arms and providing a bearing pad for abutment against an object clamped between said first and second clamp arms.

5. The combination according to claim 4, in which said bearing pad lies on the same side of said slide bar as said clamp arms, and means on the bearing block on the opposite side of said slide bar for suspending objects from said bearing block.

* * * * *